US012595645B1

(12) United States Patent
Yan

(10) Patent No.: US 12,595,645 B1
(45) Date of Patent: Apr. 7, 2026

(54) SHOWER FIXING DEVICE

(71) Applicant: Xiamen Galenpoo Kitchen & Bathroom Technology Co., Ltd., Xiamen (CN)

(72) Inventor: Xiaoling Yan, Xiamen (CN)

(73) Assignee: Xiamen Galenpoo Kitchen & Bathroom Technology Co., Ltd., Xiamen (CN)

( * ) Notice: Subject to any disclaimer, the term of this patent is extended or adjusted under 35 U.S.C. 154(b) by 0 days.

(21) Appl. No.: 19/390,712

(22) Filed: Nov. 17, 2025

(30) Foreign Application Priority Data

Nov. 3, 2025 (CN) ..... 202522328157.3

(51) Int. Cl.
*E03C 1/06* (2006.01)

(52) U.S. Cl.
CPC ..... *E03C 1/06* (2013.01)

(58) Field of Classification Search
CPC ..... E03C 1/06
See application file for complete search history.

(56) References Cited

U.S. PATENT DOCUMENTS 8,684,039 B2 * 4/2014 Cai ..... E03C 1/06 4/615
12,220,715 B2 * 2/2025 Davies ..... B05B 15/652

FOREIGN PATENT DOCUMENTS

CN 109138066 A 1/2019
CN 210994956 U 7/2020
CN 215105751 U 12/2021

* cited by examiner

*Primary Examiner* — P. Macade Nichols
(74) *Attorney, Agent, or Firm* — Nitin Kaushik

(57) ABSTRACT

A shower fixing device includes a fixed seat and a movable arm. The fixed seat has a switch valve, a water inlet end, a first water outlet end, and a second water outlet end. The switch valve controls communication between the water inlet end and the first and/or second water outlet ends. The movable arm contains no waterway; one end is rotatably connected to the fixed seat, and the other end holds a first shower. The movable arm rotates 360 degrees around the fixed seat. The first water outlet end connects to the first shower via a flexible hose, while the second water outlet end supplies a second shower. This allows water output at different heights or left-right positions to meet various user needs. Moreover, the absence of a waterway in the movable arm prevents leakage during frequent rotation.

10 Claims, 6 Drawing Sheets

SHOWER FIXING DEVICE

CROSS-REFERENCE TO RELATED APPLICATIONS

The application claims priority to Chinese patent application No. 202522328157.3, filed on Nov. 3, 2025, the entire contents of which are incorporated herein by reference.

TECHNICAL FIELD

This application relates to the technical field of bathroom products, in particular to a shower fixing device.

BACKGROUND

A shower, also known as a showerhead, is a showering device that disperses water flow through a nozzle. Previous showers could only be fixedly placed on a fixed shower holder provided on the wall, which has the defect that the position and height of the shower cannot be adjusted, making it inconvenient to use.

Therefore, shower rod assemblies appeared on the market, allowing the shower to be slidably connected to a sliding seat on the shower rod to achieve adjustable height. However, shower rod assemblies are generally large in size, occupy space, and are complex to install, and the shower can only be adjusted in vertical height, not in the left-right direction.

For example, Chinese Patent Publication No. CN 118207940 A disclosed a spraying mechanism and a water outlet device. In this solution, by means of rotating a support arm assembly relative to a water inlet assembly and rotating a first shower relative to the support arm assembly, the first shower has multiple positions to meet the needs of users for different shower positions. However, although the first shower in this solution can be rotationally adjusted in position, it is supplied with water through a waterway inside the support arm assembly, and after frequent relative rotation of the support arm assembly with respect to the water inlet assembly, the rotating connection between the two is easily worn, leading to water leakage and affecting the user experience.

SUMMARY

An objective of this application is to provide a shower fixing device, having an adjustable shower and a stable and reliable structure, with the advantage of not being prone to water leakage.

To achieve the above objective, the solution of this application is:

The shower fixing device includes a fixed seat and a movable arm, where the fixed seat is provided with a switch valve, a water inlet end, a first water outlet end, and a second water outlet end, and the switch valve is used for switching to control the water inlet end to communicate with the first water outlet end and/or the second water outlet end.

No waterway is provided in the movable arm, the movable arm has one end rotatably connected to the fixed seat and the other end used for mounting a first shower, the movable arm is capable of rotating 360 degrees around the fixed seat, the first water outlet end is used for communicating with the first shower through a flexible hose, and the second water outlet end is used for communicating with a second shower.

Further, one end of the movable arm has a sleeving tube, and the fixed seat has a sleeve connection column for the sleeving tube to rotatably sleeve thereon.

Further, a wear-resistant ring is also provided between the sleeve connection column of the fixed seat and the sleeving tube, an inner ring of the wear-resistant ring is fixedly connected to the sleeve connection column, and an outer peripheral wall of a wear-resistant bushing is interference-fitted to an inner wall of the sleeving tube.

Further, the water inlet end and the second water outlet end are respectively disposed at two ends of the fixed seat, the movable arm and the first water outlet end are located between the two ends of the fixed seat, and the movable arm rotates about an axis defined by a line connecting the two ends of the fixed seat.

Further, the fixed seat is provided with a water inlet seat at a rear part and with a sleeve connection column on a front side, the movable arm has a sleeving tube rotatably sleeved on the sleeve connection column, an interior of the water inlet seat is provided with a switching chamber with a side opening, the switch valve is installed in the switching chamber from the side opening, the water inlet end is provided at a rear end of the fixed seat and communicates with the switching chamber, the first water outlet end is provided on a side surface of the water inlet seat and communicates with the switching chamber, and the second water outlet end is provided at a front end of the sleeve connection column and communicates with the switching chamber through a water passing channel inside the sleeve connection column.

Further, the fixed seat is provided with a water inlet seat at a rear part and with a sleeve connection column on a front side, the movable arm has a sleeving tube rotatably sleeved on the sleeve connection column, the sleeve connection column has an outer diameter less than that of the water inlet seat, forming a rear limiting step surface with the water inlet seat, a limiting element is detachably installed at a front end of the sleeve connection column, and the sleeving tube has a rear end that abuts against and is limited by the rear limiting step surface and a front end that abuts against and is limited by a rear side of the limiting element.

Further, the sleeve connection column includes a sleeve connection part and a connecting part, a wear-resistant ring is installed between the sleeve connection part and the sleeving tube, the connecting part has an outer diameter less than that of the sleeve connection part, forming a front limiting step surface with the sleeve connection part, a ring of limiting flange radially protrudes from a middle part of an inner wall of the sleeving tube, the limiting flange extends to a front side of the front limiting step surface, and a rear side of the limiting element is further provided with a pressing sleeve element that presses against a front side of the limiting flange.

Further, the connecting part is provided with an external thread and extends forward beyond a front end of the sleeving tube, the limiting element is screwed to the connecting part, and the second water outlet end is provided at a front end of the connecting part.

Further, a fixed arm having a water passage inside is further provided on the fixed seat, an end of the fixed arm away from the fixed seat is provided with a third water outlet end for connecting and communicating with a third shower, the third water outlet end communicates with the water passage of the fixed arm, and the water passage of the fixed arm also communicates with the second water outlet end.

Further, the other end of the movable arm away from the fixed seat is provided with a magnetic attraction shower holder, the magnetic attraction shower holder includes a connection seat, a movable head, and a magnetic attraction assembly, the connection seat is detachably connected to the movable arm on one side and has a movable hole on the other side, one side of the movable head is provided with a ball head, the ball head is rotatably assembled in the movable hole, the other side of the movable head is installed with the magnetic attraction assembly, and the magnetic attraction assembly is configured to movably attract and fix the first shower.

After the use of the above technical solution, in this application, with the provision of the movable arm capable of rotating 360 degrees around the fixed seat, the first shower can be driven to perform 360-degree rotational adjustment around the fixed seat. This can achieve water output at different heights or left-right positions to meet the usage needs of different people and scenarios, with good practicality. At the same time, no waterway structure is provided inside the movable arm, but rather the first water outlet end located on the fixed seat supplies water to the first shower through a flexible hose, which can prevent situations such as water seepage or leakage in the frequently rotating movable arm.

Figure 1:
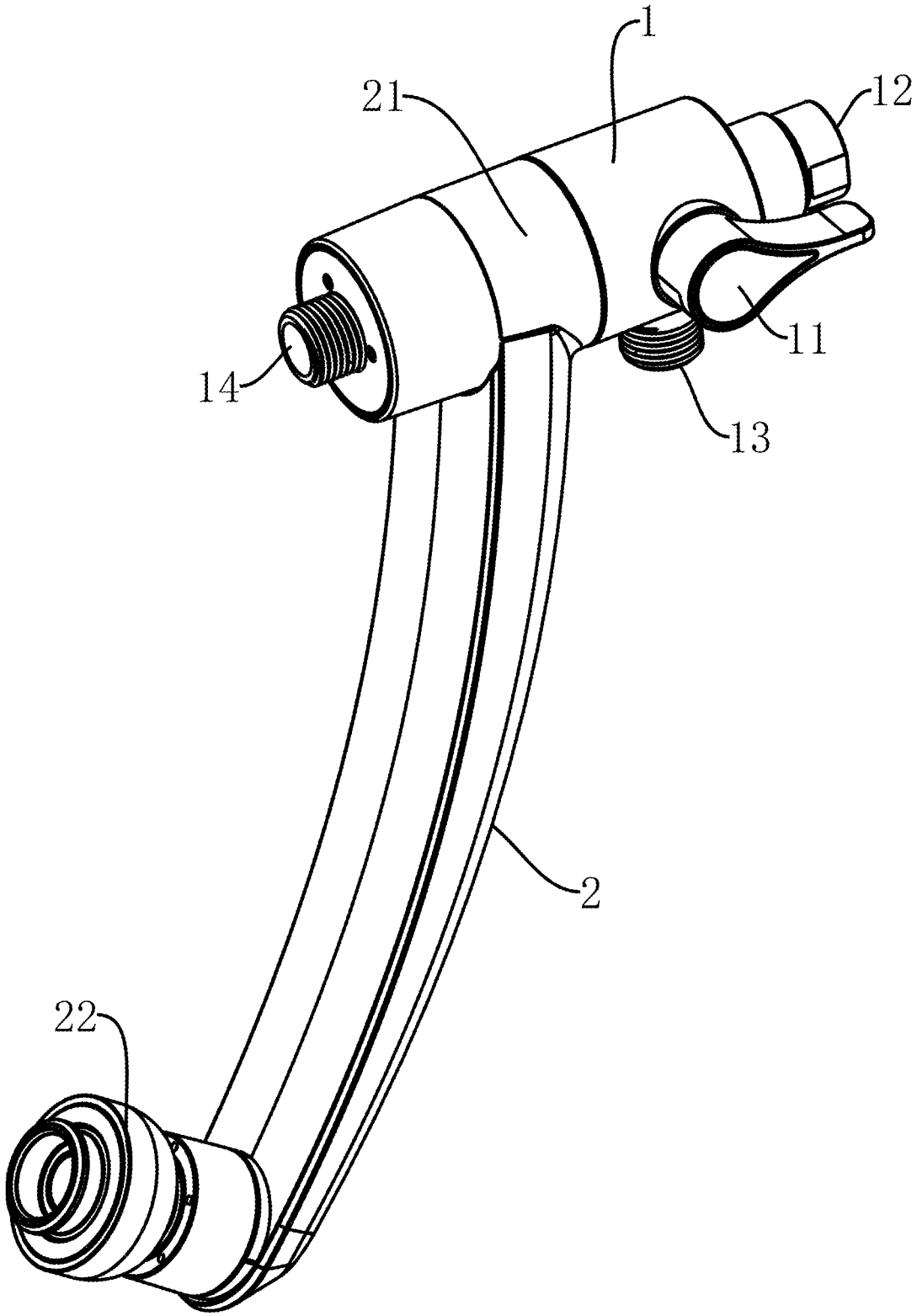
FIG. 1 is a perspective view according to Embodiment 1 of this application.

Description of reference numerals: fixed seat 1, switch valve 11, water inlet end 12, first water outlet end 13, second water outlet end 14, sleeve connection column 15, embedding groove 151, water passing channel 152, sleeve connection part 153, connecting part 154, front limiting step surface 155, wear-resistant ring 16, rib 161, convex rib 162, water inlet seat 17, switching chamber 171, side opening 172, water inlet hole 173, first water outlet hole 174, second water outlet hole 175, rear limiting step surface 176, limiting element 18, pressing sleeve element 19; movable arm 2, sleeving tube 21, limiting flange 211, magnetic attraction shower holder 22, connection seat 221, movable hole 2211, movable head 222, ball head 2221, magnetic attraction assembly 223; fixed arm 3, water passage 31, and third water outlet end 32.

DETAILED DESCRIPTION OF THE EMBODIMENTS

To make the objective, technical solutions, and advantages of the embodiments of this application clearer, the technical solutions in the embodiments of this application will be clearly and completely described below with reference to the drawings in the embodiments of this application. Obviously, the described embodiments are some embodiments of this application, rather than all embodiments. The components of the embodiments of this application generally described and shown in the drawings herein can be arranged and designed in different configurations.

Embodiment 1

As shown in FIGS. 1 to 5, a shower fixing device of this embodiment includes a fixed seat 1 and a movable arm 2. The fixed seat 1 is provided with a switch valve 11, a water inlet end 12, a first water outlet end 13, and a second water outlet end 14. The switch valve 11 is used for switching to control the water inlet end 12 to communicate with the first water outlet end 13 and/or the second water outlet end 14.

The movable arm 2 can be arc-shaped and no waterway is provided inside. The movable arm 2 has one end rotatably connected to the fixed seat 1 and the other end used for mounting a first shower (not shown in the figure). The movable arm 2 is capable of rotating 360 degrees around the fixed seat 1. The first water outlet end 13 is used for communicating with the first shower through a flexible hose (not shown in the figure), and the second water outlet end 14 is used for communicating with a second shower (not shown in the figure).

By this means, in this embodiment, with the provision of the movable arm 2 capable of rotating 360 degrees around the fixed seat 1, the first shower can be driven to perform 360-degree rotational adjustment around the fixed seat 1. This can achieve water output at different heights or left-right positions to meet the usage needs of different people and scenarios, with good practicality. At the same time, no waterway structure is provided inside the movable arm 2, but rather the first water outlet end 13 located on the fixed seat 1 supplies water to the first shower through a flexible hose, which can prevent situations such as water seepage or leakage in the frequently rotating movable arm 2.

The first shower in this embodiment may be a handheld shower or the like, the second shower may be a top spray or the like, and the flexible hose may be a metal hose or a plastic hose. Certainly, the specific types are not limited to those described in this embodiment.

Figure 2:
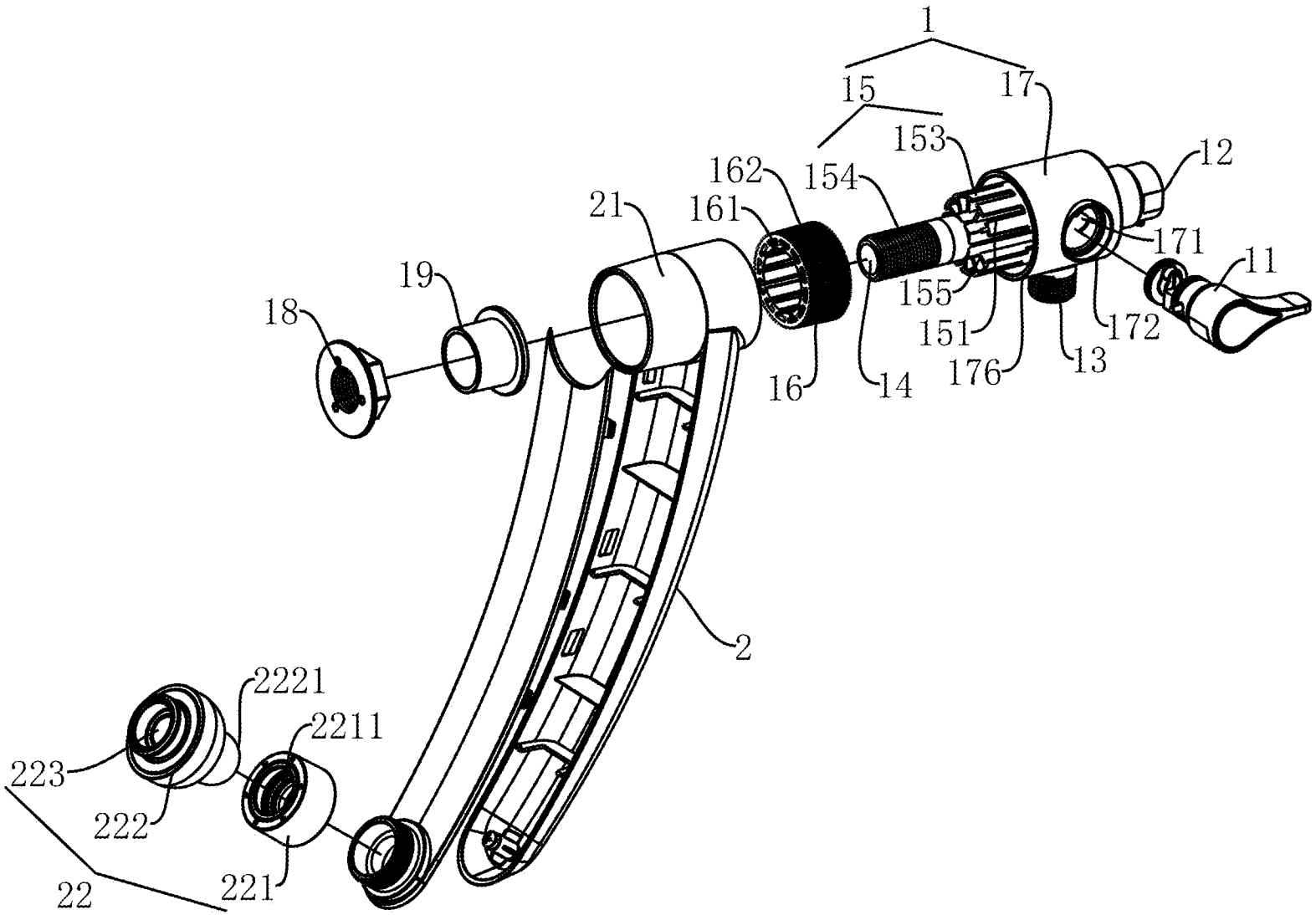
FIG. 2 is an exploded view according to Embodiment 1 of this application.
Figure 3:
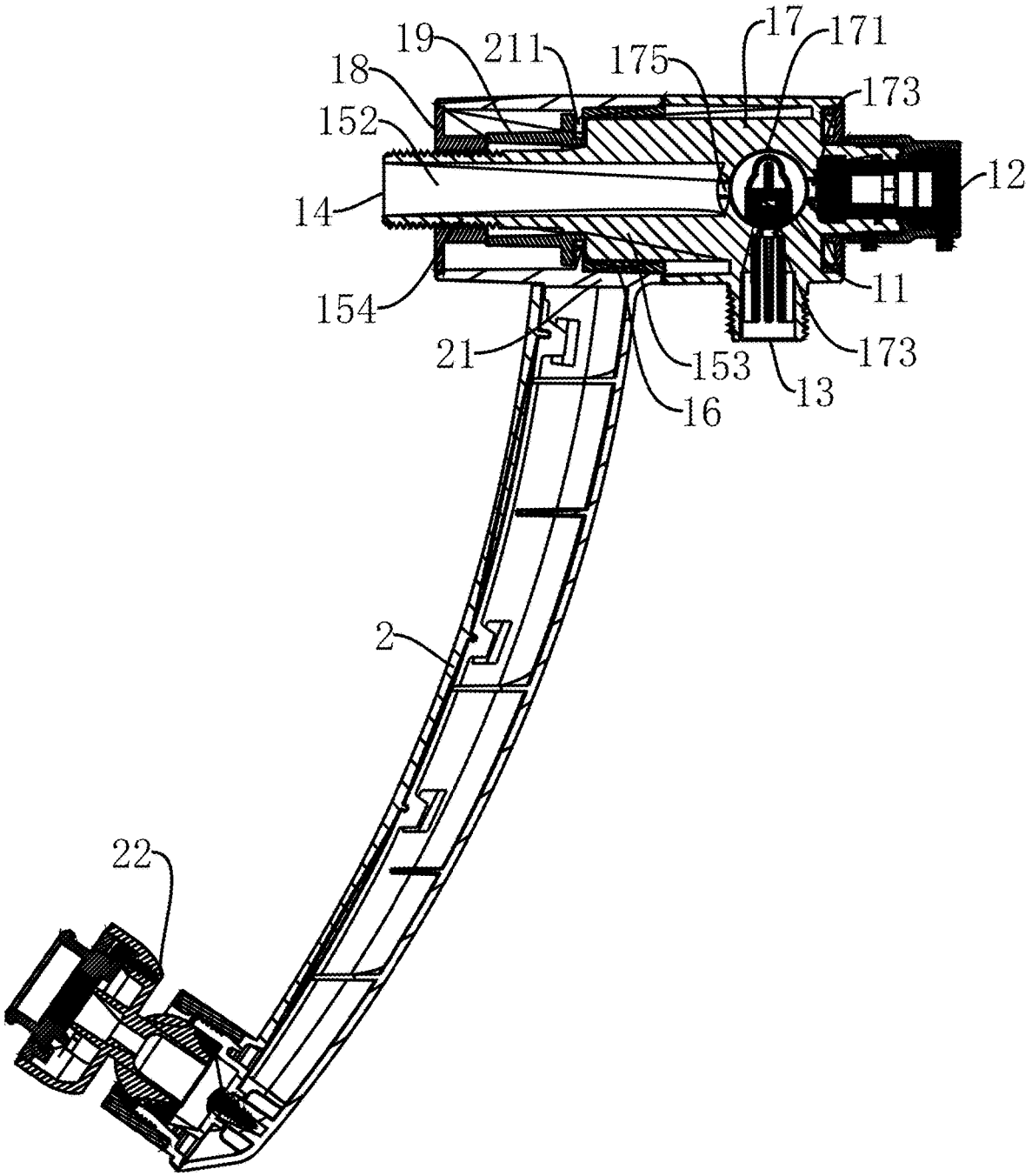
FIG. 3 is a cross-sectional view according to Embodiment 1 of this application.
Figure 4:
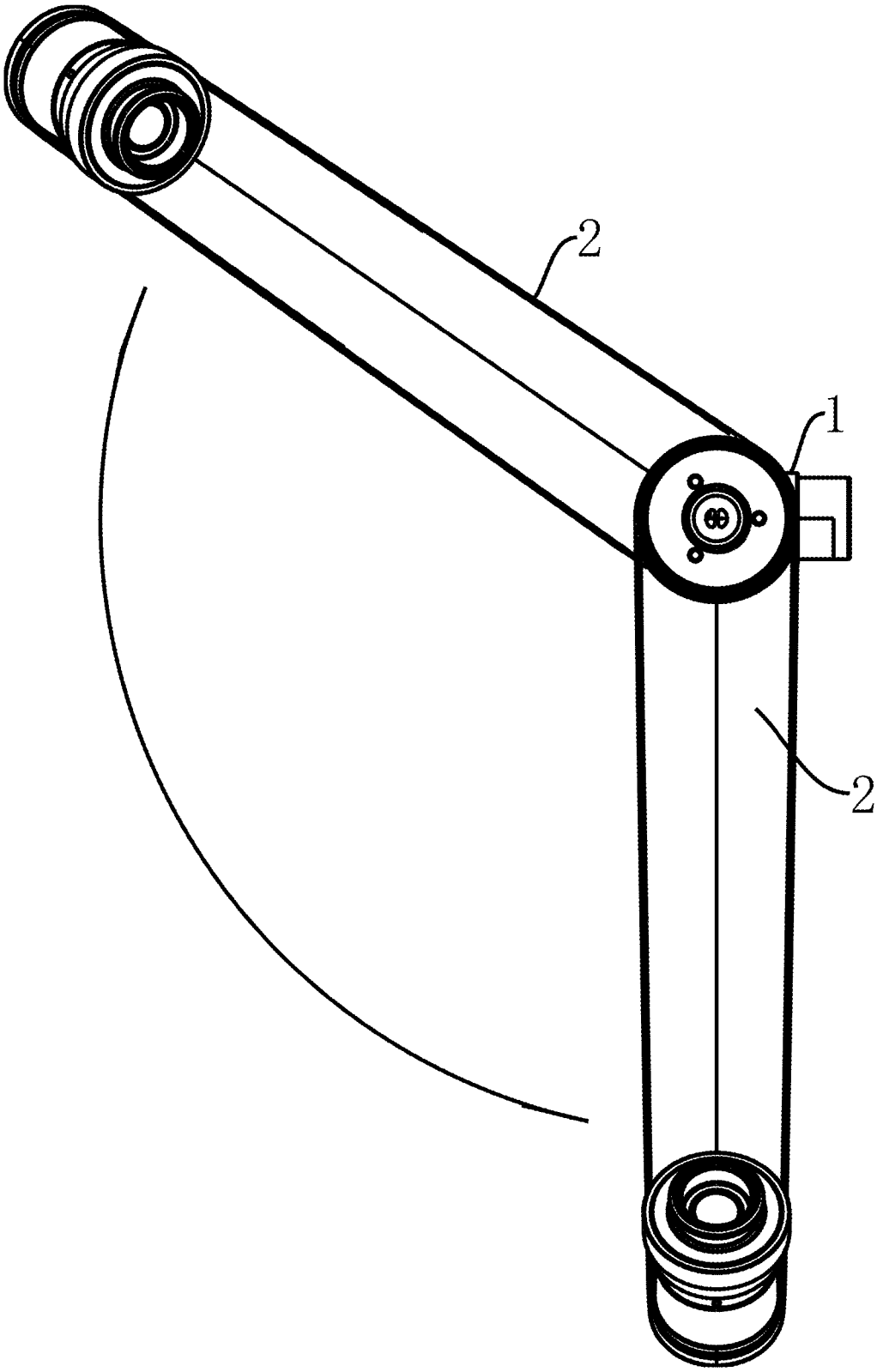
FIG. 4 is a schematic diagram of rotation of a movable arm according to Embodiment 1 of this application.

As shown in FIG. 2, one end of the movable arm 2 may have a sleeving tube 21. The fixed seat 1 has a sleeve connection column 15 for the sleeving tube 21 to rotatably sleeve thereon. This facilitates the 360-degree rotation of the movable arm 2 around the fixed seat 1.

At the same time, a wear-resistant ring 16 made of rubber or other materials may also be provided between the sleeve connection column 15 of the fixed seat 1 and the sleeving tube 21. The inner ring of the wear-resistant ring 16 can be provided with several circumferentially spaced "T"-shaped ribs 161 to facilitate snap-fitting and fixing into several embedding grooves 151 circumferentially provided on the sleeve connection column 15. The outer peripheral wall of the wear-resistant ring 16 can be interference-fitted to the inner wall of the sleeving tube 21 to improve the rotation feel and allow the movable arm 2 to maintain the desired position after rotation without falling. The outer peripheral wall of the wear-resistant ring 16 in this embodiment may also be provided with circumferentially densely arranged convex ribs 162 to improve the fixing effect after rotation of the movable arm 2.

In this embodiment, the fixed seat 1 is exemplified by a columnar structure extending front and rear. The water inlet end 12 and the second water outlet end 14 may be respectively disposed at two ends of the fixed seat 1. The water inlet end 12 may be connected and fixed to a water inlet pipe on the wall (not shown in the figure), and the second shower may be installed at the second water outlet end 14. The movable arm 2 and the first water outlet end 13 are located between the two ends of the fixed seat 1. The movable arm 2 can rotate about an axis defined by a line connecting the two ends of the fixed seat 1, that is, the movable arm 2 can carry the first shower to rotate around the fixed seat 1 and the second shower.

Specifically, the fixed seat 1 may be provided with a water inlet seat 17 at a rear part and with the sleeve connection column 15 on a front side.

The interior of the water inlet seat 17 is provided with a switching chamber 171 with a side opening 172. The switch valve 11 is installed in the switching chamber 171 from the side opening 172. The water inlet end 12 is provided at a rear end of the fixed seat 1 and communicates with a water inlet hole 173 of the switching chamber 171. The first water outlet end 13 is provided on a side surface of the water inlet seat 17 and communicates with a first water outlet hole 174 of the switching chamber 171. The second water outlet end 14 is provided at a front end of the sleeve connection column 15 and communicates with a second water outlet hole 175 of the switching chamber 171 through the water passing channel 152 inside the sleeve connection column 15. The switch valve 11 is used to movably block the first water outlet hole 174 or the second water outlet hole 175. The switch valve 11 can also open the first water outlet hole 174 and the second water outlet hole 175 simultaneously. Thus, communication can be enabled conveniently for the first shower or the second shower, or for the first shower and the second shower simultaneously.

The specific structure of the switch valve 11 may refer to the prior art and will not be repeated here.

In this embodiment, the sleeve connection column 15 has an outer diameter less than that of the water inlet seat 17, forming a rear limiting step surface 176 with the water inlet seat 17. A limiting element 18 is detachably installed at a front end of the sleeve connection column 15. The sleeving tube 21 has a rear end that abuts against and is limited by the rear limiting step surface 176 and a front end that abuts against and is limited by a rear side of the limiting element 18. This facilitates the assembly and production of the movable arm 2.

Furthermore, the sleeve connection column 15 in this embodiment further includes a sleeve connection part 153 and a connecting part 154. The wear-resistant ring 16 may be installed between the sleeve connection part 153 and the sleeving tube 21.

The connecting part 154 may have an outer diameter less than that of the sleeve connection part 153, forming a front limiting step surface 155 with the sleeve connection part 153. A ring of limiting flange 211 may radially protrude from a middle part of an inner wall of the sleeving tube 21, and the limiting flange 211 extends to a front side of the front limiting step surface 155. A rear side of the limiting element 18 is further provided with a pressing sleeve element 19 that presses against a front side of the limiting flange 211.

By this means, a tight and stable fitting relationship may be formed between the sleeving tube 21 and the sleeve connection column 15, which can improve the stability and reliability of the rotation of the movable arm 2.

At the same time, the connecting part 154 may be provided with an external thread, and the connecting part 154 extends forward beyond a front end of the sleeving tube 21. The second water outlet end 14 is provided at a front end of the connecting part 154 to facilitate screw connection and fixing of the second shower. The limiting element 18 may be screwed to the connecting part 154, helping to limit the front end of the sleeving tube 21 of the movable arm 2.

In this embodiment, the other end of the movable arm 2 away from the fixed seat 1 may be provided with a magnetic attraction shower holder 22 to facilitate quick magnetic attraction and fixing of the first shower, such as a handheld shower, which can be more convenient for users.

Specifically, the magnetic attraction shower holder 22 may include a connection seat 221, a movable head 222, and a magnetic attraction assembly 223. The connection seat 221 is detachably connected to the movable arm 2 on one side and has a movable hole 2211 on the other side. One side of the movable head 222 is provided with a ball head 2221, and the ball head 2221 is rotatably assembled in the movable hole 2211. The other side of the movable head 222 is installed with the magnetic attraction assembly 223, and the magnetic attraction assembly 223 is configured to movably attract and fix the first shower. The structure of the magnetic attraction assembly 223 may refer to the prior art.

Embodiment 2

Figure 5:
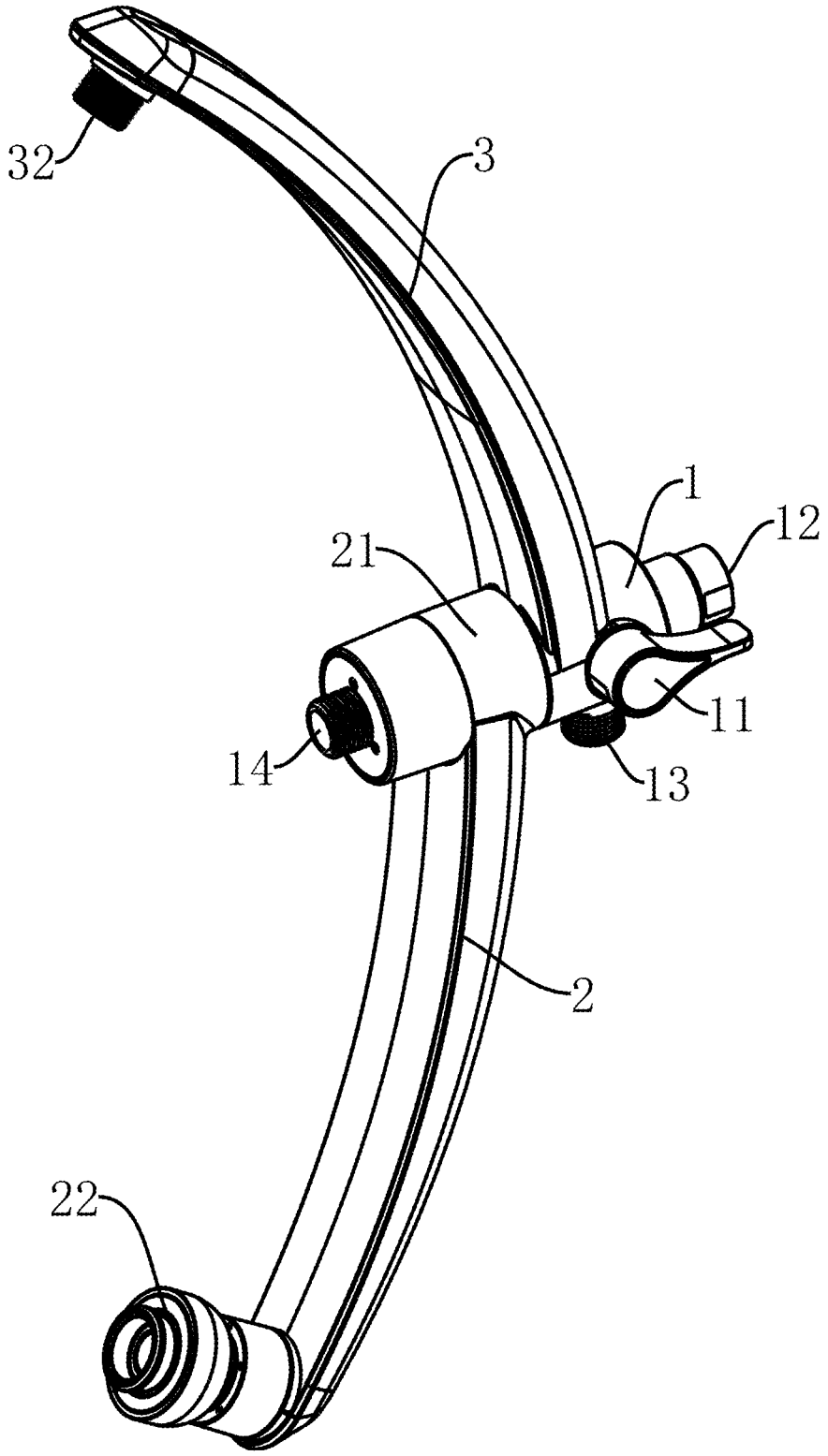
FIG. 5 is a perspective view according to Embodiment 2 of this application.
Figure 6:
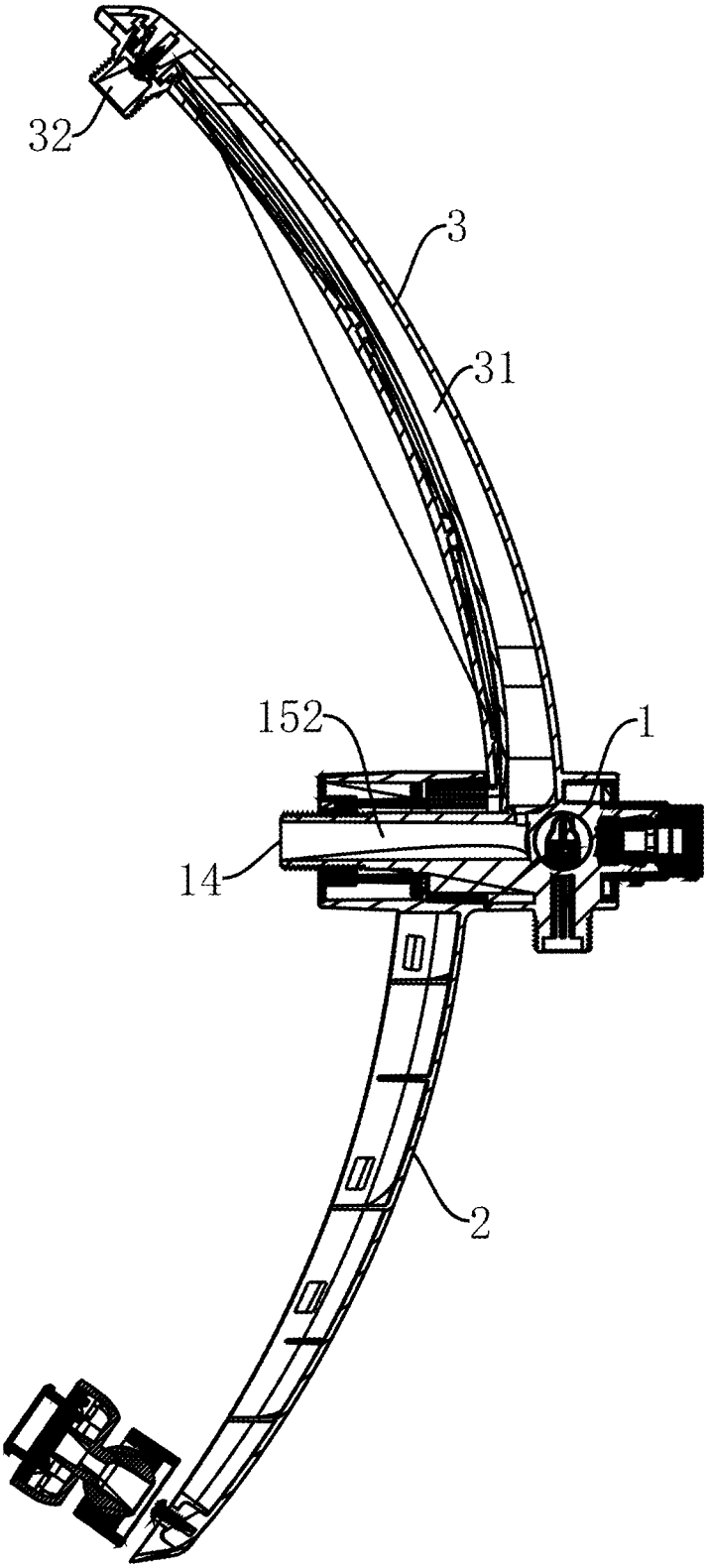
FIG. 6 is a cross-sectional view according to Embodiment 2 of this application.

As shown in FIG. 5 and FIG. 6, the structure of this embodiment is basically the same as that of the above embodiment, the main difference being that a fixed arm 3 having a water passage 31 inside is further provided on the fixed seat 1.

In this embodiment, the fixed arm 3 may be provided on an upper part of the fixed seat 1 and may also be arc-shaped. The movable arm 2 can generally be rotated to be used below the fixed arm 3 and the fixed seat 1, but certainly it is not limited thereto. The fixed arm 3 may be provided to the left or right for use.

Specifically, an end of the fixed arm 3 away from the fixed seat 1 may be provided with a third water outlet end 32 for connecting and communicating with a third shower (not shown in the figure). The third shower may also be a top spray. The third water outlet end 32 communicates with the water passage 31 of the fixed arm 3. The water passage 31 of the fixed arm 3 can simultaneously communicate with the water passing channel 152 inside the sleeve connection column 15, and then communicate with the second water outlet end 14.

Thus, in this embodiment, the third shower can be controlled to output water while the second shower can be controlled to output water, to meet water shower needs in different scenarios, with rich functions.

The above descriptions are only preferred implementations of this application, and the protection scope of this application is not limited to the above embodiments. All technical solutions falling under the idea of this application belong to the protection scope of this application. It should be pointed out that for those of ordinary skill in the art, equivalent changes and modifications made without departing from the principle of this application should still fall within the protection scope of this application.

In the description of the embodiments of this application, it should be understood that the indicated orientation or positional relationships are based on the orientations or positional relationships shown in the drawings, or the orientations or positional relationships conventionally placed when the product of this application is used, or the orientations or positional relationships conventionally understood by those skilled in the art, and are only for the convenience of describing this application and simplifying the description, rather than indicating or implying that the referred device or element must have a specific orientation, be constructed and operated in a specific orientation, and therefore cannot be understood as a limitation on this application.

In the description of this application, "multiple" and "several" mean two or more, unless otherwise clearly and specifically defined.

What is claimed is:

1. A shower fixing device, comprising a fixed seat and a movable arm, wherein the fixed seat is provided with a switch valve, a water inlet end, a first water outlet end, and a second water outlet end, and the switch valve is used for switching to control the water inlet end to communicate with the first water outlet end and/or the second water outlet end; wherein no waterway is provided in the movable arm, the movable arm has one end rotatably connected to the fixed seat and the other end used for mounting a first shower, the movable arm is capable of rotating 360 degrees around the fixed seat, the first water outlet end is used for communicating with the first shower through a flexible hose, and the second water outlet end is used for communicating with a second shower.

2. The shower fixing device according to claim 1, wherein one end of the movable arm has a sleeving tube, and the fixed seat has a sleeve connection column for the sleeving tube to rotatably sleeve thereon.

3. The shower fixing device according to claim 2, wherein a wear-resistant ring is also provided between the sleeve connection column of the fixed seat and the sleeving tube, an inner ring of the wear-resistant ring is fixedly connected to the sleeve connection column, and an outer peripheral wall of a wear-resistant bushing is interference-fitted to an inner wall of the sleeving tube.

4. The shower fixing device according to claim 1, wherein the water inlet end and the second water outlet end are respectively disposed at two ends of the fixed seat, the movable arm and the first water outlet end are located between the two ends of the fixed seat, and the movable arm rotates about an axis defined by a line connecting the two ends of the fixed seat.

5. The shower fixing device according to claim 1, wherein the fixed seat is provided with a water inlet seat at a rear part and with a sleeve connection column on a front side, the movable arm has a sleeving tube rotatably sleeved on the sleeve connection column, an interior of the water inlet seat is provided with a switching chamber with a side opening, the switch valve is installed in the switching chamber from the side opening, the water inlet end is provided at a rear end of the fixed seat and communicates with the switching chamber, the first water outlet end is provided on a side surface of the water inlet seat and communicates with the switching chamber, and the second water outlet end is provided at a front end of the sleeve connection column and communicates with the switching chamber through a water passing channel inside the sleeve connection column.

6. The shower fixing device according to claim 1, wherein the fixed seat is provided with a water inlet seat at a rear part and with a sleeve connection column on a front side, the movable arm has a sleeving tube rotatably sleeved on the sleeve connection column, the sleeve connection column has an outer diameter less than that of the water inlet seat, forming a rear limiting step surface with the water inlet seat, a limiting element is detachably installed at a front end of the sleeve connection column, and the sleeving tube has a rear end that abuts against and is limited by the rear limiting step surface and a front end that abuts against and is limited by a rear side of the limiting element.

7. The shower fixing device according to claim 6, wherein the sleeve connection column comprises a sleeve connection part and a connecting part, a wear-resistant ring is installed between the sleeve connection part and the sleeving tube, the connecting part has an outer diameter less than that of the sleeve connection part, forming a front limiting step surface with the sleeve connection part, a ring of limiting flange radially protrudes from a middle part of an inner wall of the sleeving tube, the limiting flange extends to a front side of the front limiting step surface, and a rear side of the limiting element is further provided with a pressing sleeve element that presses against a front side of the limiting flange.

8. The shower fixing device according to claim 7, wherein the connecting part is provided with an external thread and extends forward beyond a front end of the sleeving tube, the limiting element is screwed to the connecting part, and the second water outlet end is provided at a front end of the connecting part.

9. The shower fixing device according to claim 1, wherein a fixed arm having a water passage inside is further provided on the fixed seat, an end of the fixed arm away from the fixed seat is provided with a third water outlet end for connecting and communicating with a third shower, the third water outlet end communicates with the water passage of the fixed arm, and the water passage of the fixed arm also communicates with the second water outlet end.

10. The shower fixing device according to claim 1, wherein the other end of the movable arm away from the fixed seat is provided with a magnetic attraction shower holder, the magnetic attraction shower holder comprises a connection seat, a movable head, and a magnetic attraction assembly, the connection seat is detachably connected to the movable arm on one side and has a movable hole on the other side, one side of the movable head is provided with a ball head, the ball head is rotatably assembled in the movable hole, the other side of the movable head is installed with the magnetic attraction assembly, and the magnetic attraction assembly is configured to movably attract and fix the first shower.

* * * * *